US005092574A

United States Patent [19]

Braen et al.

[11] Patent Number: 5,092,574

[45] Date of Patent: Mar. 3, 1992

[54] APPARATUS FOR FEEDING SHEETS

[75] Inventors: Henry P. Braen, Wilton; William J. Wright, Killingworth; Eric A. Belec, Southbury, all of Conn.

[73] Assignee: Pitney Bowes Inc., Stamford, Conn.

[21] Appl. No.: 577,975

[22] Filed: Sep. 5, 1990

[51] Int. Cl.[5] ..... B65H 3/04

[52] U.S. Cl. ..... 271/2; 271/34; 271/150

[58] Field of Search ..... 271/2, 34, 31.1, 149, 271/150

[56] References Cited

U.S. PATENT DOCUMENTS

| | | | |
|---|---|---|---|
| 3,759,503 | 9/1973 | Peterson | 271/150 |
| 3,970,298 | 7/1976 | Irvine | 271/34 |
| 3,981,493 | 9/1976 | Klappenecker | 271/34 X |
| 3,982,749 | 9/1976 | Stobb | 271/149 X |
| 4,302,000 | 11/1981 | Frank | 271/34 X |
| 4,634,111 | 1/1987 | Frank | 271/150 X |
| 4,884,797 | 12/1989 | Svyatsky | 271/150 X |

OTHER PUBLICATIONS

IBM Technical Disclosure Bulletin, vol. 19, No. 2, pp. 623, 624, Edge Feed Loader for Mail Transport, T. L. Johnson et al., Jul. 1976.

*Primary Examiner*—Richard A. Schacher

*Attorney, Agent, or Firm*—Donald P. Walker; David E. Pitchenik; Melvin J. Scolnick

[57] ABSTRACT

Apparatus for feeding sheets respectively having an upright surface and a lower edge, the apparatus comprising: structure for supporting a stack of said sheets on said lower edges thereof; first structure for feeding said sheets of said stack in a downstream path of travel; second structure for feeding said sheets on said lower edges thereof from said stack in a direction extending transverse to said path of travel, said second sheet feeding structure including structure for frictionally engaging the upright surfaces of successive sheets; and structure for resiliently urging said structure for frictionally engaging into engagement with said upright surfaces of successive sheets.

17 Claims, 2 Drawing Sheets

APPARATUS FOR FEEDING SHEETS

BACKGROUND OF THE INVENTION

This invention is generally concerned with sheet feeding apparatus and more particularly with apparatus for feeding sheets respectively supported on an edge thereof, whereby such sheets are fed in an upright orientation thereof.

This application is related to U.S. application Ser. No. 07/577,725 for Apparatus for Feeding Sheets From A Stack filed concurrently herewith by the same inventors and assigned to the assignee hereof.

In U.S. Pat. No. 4,302,000 for Apparatus For Separating A Letter Stack, issued Nov. 24, 1981 to Warner Frank, there is shown sheet feeding structure wherein sheets are fed on their edges from a stack of sheets. In the patent, a spring loaded supporting wall at the upstream end of the stack is intermittently moved in a downstream path of travel by a switch actuated drive system, and belt structure at the downstream end of the stack feeds the sheets from the stack. A pair of springs are provided for spring loading the upstream sheet supporting wall, and the drive system includes an arm which compresses the springs against the wall for moving the same whenever the force being exerted by the stack against the belt structure does not exceed a value which causes the drive system's switch to be actuated. The spring structure is provided to ensure that the force exerted against the belt structure, which reliably feeds sheets only when that force is within a predetermined range of values, will not attain unduly high values.

It has been found that although the spring structure shown in the Patent generally enhances the feeding reliability of the belt structure, the mass of the stack normally includes unavoidable air pockets which tend to dampen the effect of the springs. Moreover, since the forces exerted by the springs are unevenly relieved when thick sheets are fed from the stack, and a given sheet may be of varying thickness along its feeding length, the forces exerted on the belt structure may vary considerably as a given sheet is being fed from the stack. As a result, the drive system tends to require continuous adjustment to achieve reliable sheet feeding with sheets of different thicknesses. Accordingly:

An object of the invention is to provide improved apparatus for feeding sheets of different thickness;

Another object is to provide apparatus for feeding sheets from a stack, including improved structure for controlling the force exerted by the stack on the sheet feeding structure; and Another object is to provide sheet feeding apparatus including means for exerting a substantially constant resultant force against respective sheets fed thereby.

SUMMARY OF THE INVENTION

Apparatus for feeding sheets respectively having an upright surface and a lower edge, the apparatus comprising: means for supporting a stack of said sheets on said lower edges thereof; first means for feeding said sheets of said stack in a downstream path of travel; second means for feeding said sheets on said lower edges thereof from said stack in a direction extending transverse to said path of travel, said second sheet feeding means including means for frictionally engaging the upright surfaces of successive sheets; and means for resiliently urging said means for frictionally engaging into engagement with said upright surfaces of successive sheets.

BRIEF DESCRIPTION OF THE DRAWING

As shown in the drawings, wherein like reference numerals designate like or corresponding parts throughout the several views.

DESCRIPTION OF THE PREFERRED EMBODIMENTS

Figure 1A:
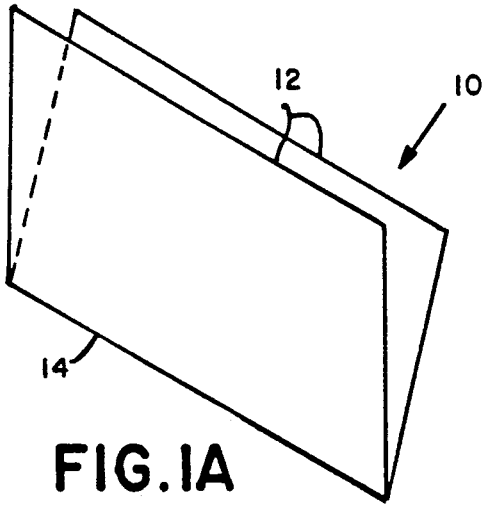
FIG. 1*a* is a perspective view of a typical folded cut sheet which may be processed according to the invention.
Figure 1B:
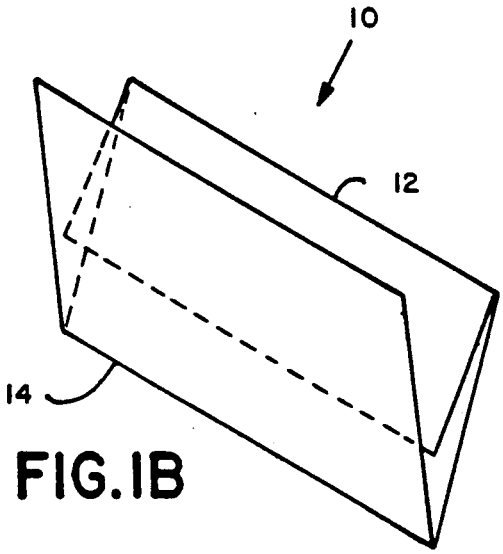
FIG. 1*b* is a perspective view of another typical folded cut sheet which may be processed according to the invention.
Figure 1C:
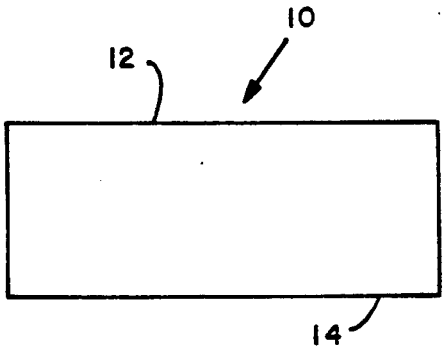
FIG. 1*c* is a plan view of another typical sheet, such as a card, cut sheet, letter, remittance slip, or the like, which may be processed according to the invention.
Figure 1D:
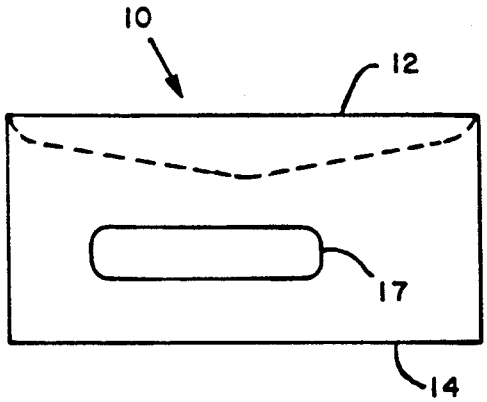
FIG. 1*d* is an end view of the stuffed envelope shown in FIG. 1*e*, showing variations in the thickness of the stuffed envelope longitudinally of its length.

As shown in FIG. 1*a*, a typical sheet 10 which may be processed in accordance with the invention may comprise a folded cut sheet or letter having opposed elongate edges 12 and 14, one of which, edge 14, is a fold edge. Another typical sheet 10 (FIG. 1*b*) may comprise a multiply folded cut sheet or letter including two elongate fold edges 12 and 14. Another typical sheet 10 (FIG. 1*c*) may comprise a cut sheet, letter, card or remittance slip, or the like, having opposed elongate edges 12 and 14. A still further typical sheet 10 (FIG. 1*d*) may comprise an unsealed envelope, having opposed elongate fold edges 12 and 14, which may or may not include a conventional window 17. And, yet another typical sheet 10 (FIG. 1*e*) may comprise a sealed envelope stuffed with one or more insert sheets 10 such as one or more of the sheets 10 shown in FIGS. 1*a*–1*d* inclusive.

Figure 1E:
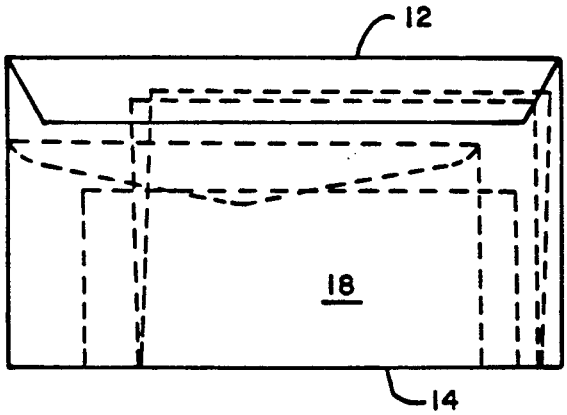
FIG. 1*e* is a plan view of another typical sheet, such as a envelope stuffed with a plurality of inserts having different dimensions, which may be processed according to the invention.
Figure 1F:
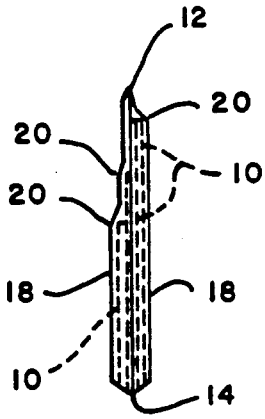
FIG. 1*f* is a plan view of yet another typical sheet, such as unsealed envelope with or without a window, which may be processed according to the invention.

As shown in FIG. 1*f* the opposed surfaces 18 of the stuffed envelope shown in FIG. 1*e* includes a plurality of ridges 20 (FIG. 1*f*), which are formed both longitudinally and transversely of the length of the envelope by the insert sheets 10 (FIG. 1*e*) stuffed in the envelope.

According to the invention, the apparatus 30 (FIG. 2) for processing sheets 10 generally includes conventional framework 32. Further, the apparatus 30 preferably comprises sheet, or stack, supporting structure 34 including an elongate, generally rectangularly-shaped, deck 36 which is suitably connected to the framework 32 for orientation thereof in a generally horizontally-extending plane.

Figure 2:
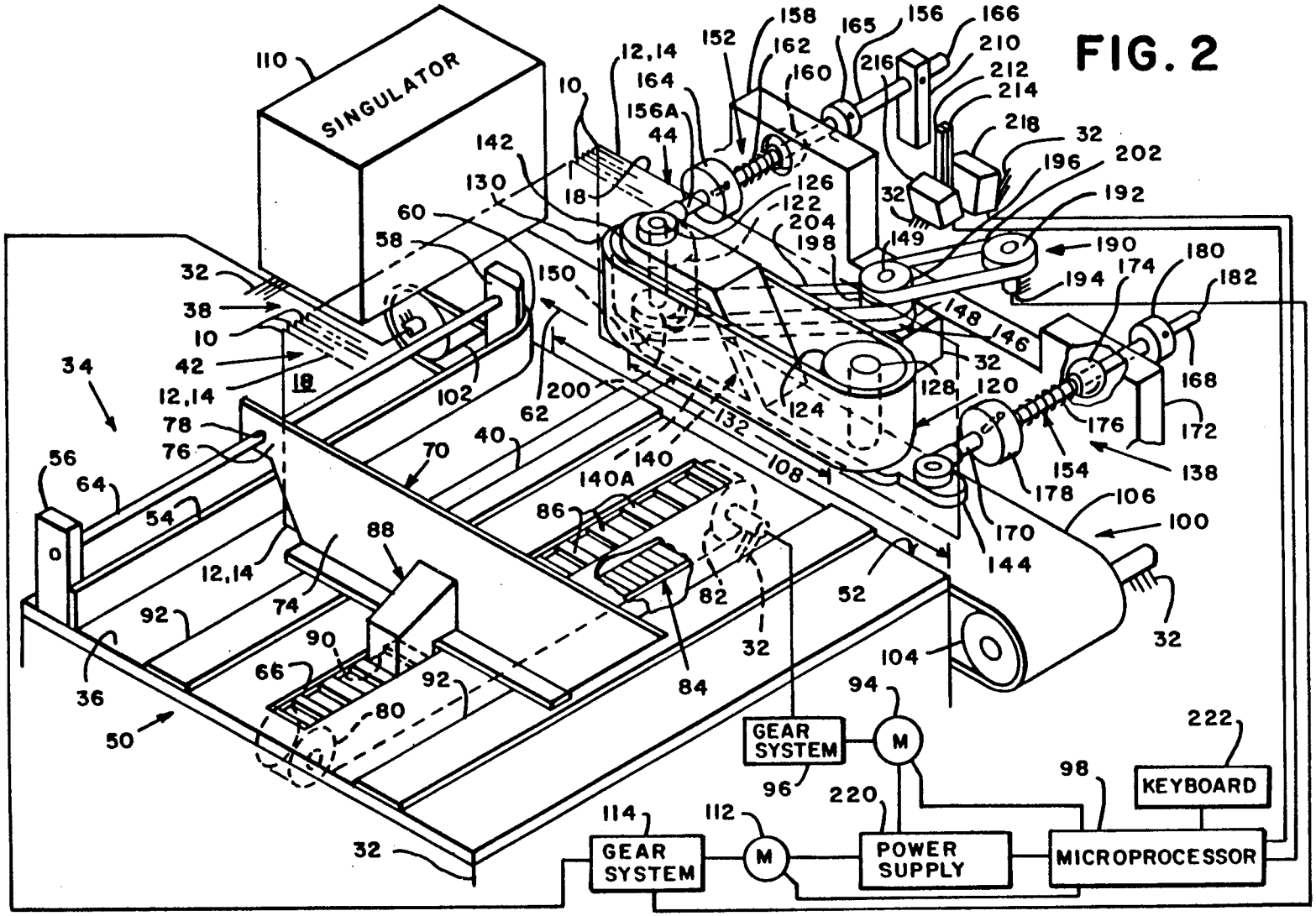
FIG. 2 is a partially schematic perspective view of sheet feeding apparatus according to the invention.

As shown in FIG. 2, a stack 38 of a plurality of sheets 10 are each supported on one of their elongate edges, 12 or 14, on the deck 36 for feeding thereon in a downstream path of travel 40. And, assuming the stack 38 includes sheets 10 having one or more fold edges, 12 or 14, they are preferably supported on a fold edge 12 or 14. Thus each of the sheets 10 of the stack 38 has opposed upper and lower elongate edges, 12 or 14, and opposed upright surfaces 18, and the stack 38 has an upstream end 42 and a downstream end 44 relative to the path of travel 40.

The sheet, or stack, supporting structure 34 (FIG. 2) and the deck 36 share an upstream end 50 and a downstream end 52. And the structure 34 additionally includes an elongate, upright, side wall 54 against which the sheets 10 of the stack 38 may be disposed in edge registration. The side wall 54 is preferably connected to a pair of upright, framework posts 56 and 58, which are spaced apart from one another and located alongside of opposite ends, 50 and 52, of the deck 36, for supporting the side wall 54 in a substantially vertical plane extending therealong. Preferably, the downstream end 60 of the side wall 54 curvedly-extends about the downstream post 58 for guiding sheets 10, fed from the stack 38, out of the path of travel 40 and into a transverse path of travel 62 which preferably extends perpendicularly-transverse to the downstream path of travel 40.

In addition, the sheet or stack supporting structure 34 (FIG. 2) includes an elongate bar 64 which is conventionally connected to and extends between the framework posts 56 and 58. And the deck 36 has an elongate, generally rectangularly-shaped, aperture 66 formed therein so as to extend parallel to the bar 64, and longitudinally of the length of the deck 36, between the deck's upstream and downstream ends 50 and 52.

For feeding the stack 38 (FIG. 2), and thus the sheets 10 thereof, in the downstream path of travel 40 on and beyond the downstream end 52 of the deck 36, the apparatus 30 includes a movable wall 70, which is disposed in engagement with the stack's upstream end 42. The wall 70, preferably includes a generally rectangularly-shaped portion 74, which engages the stack's upstream end 42, and includes an arm portion 76. The arm portion 76 has an opening 78 formed therein which is dimensioned to receive therethrough the elongate bar 64, for pivotably attaching the arm portion 76, and thus the movable wall 70, to the bar 64. As thus constructed and arranged, the arm portion 76, and thus the movable wall 70, is slideably connected to the bar 64 for movement longitudinally of the length of the supporting structure 34 and thus the deck 36. In addition, for moving the wall 70, the apparatus 30 preferably includes a pair of pulley-type gears, 80 and 82, which are spaced apart from each other and conventionally connected to the framework 32 so as to extend transversely of the sheet supporting structure 34, beneath the deck's upstream and downstream ends 50 and 52. And, the apparatus 30 includes an endless timing belt 84 which is looped about and disposed in meshing engagement with the pulley gears 80 and 82. Further, the belt 84 includes a plurality of gear teeth 86 which are formed in the outer surface of the belt 84. And the apparatus 30 includes a depending foot member 88 which is conventionally fixedly attached to the wall portion 74, as by welding, and extends downwardly through the deck's aperture 66. The foot member 88 includes a plurality of gear teeth 90 which are normally disposed in meshing engagement with timing belt's outer gear teeth 86. In addition, for slidably supporting the lower elongate ends, 12 or 14, of the sheets 10 on the deck 36, the apparatus 30 may include a plurality of, such as two, elongate strips 92 made of a plastic material, such as teflon, which are conventionally adhesively connected to the deck 36 on opposite sides of the deck's aperture 66, so as to extend longitudinally of the length of the deck 36. Still further, for feeding the stack 38 in the downstream path of travel 40, the apparatus 30 includes conventional structure for driving the pulley gear 82, including a conventional motor 94, such as a suitable stepper motor, a suitable gear system 96 which is connected in driving engagement with the pulley gear 82 and in driven engagement with the motor 94, and a conventional control circuit, such as a suitable microprocessor 98, which is conventionally connected to the motor 94 for control thereof as hereinafter discussed in greater detail.

For separating sheets 10 (FIG. 2) from the stack 38 and feeding the sheets 10 into the transverse path of travel 62, the apparatus 30 may comprise a first belt system 100 including a pair of rollers, 102 and 104, which are spaced from each other and conventionally connected to the framework 32 so as to axially extend parallel to the path of travel 40. Moreover the rollers 102 and 104 extend downstream of and below the level of the deck's downstream end 52. In addition, the belt system 100 includes an endless belt 106 which is looped about and disposed in driven engagement with the rollers 102 and 104. The belt 106 includes a belt run 108 which extends perpendicularly transverse to the path of travel 40 for receiving thereon the lower elongate edges, 12 or 14, of respective sheets 10, which are fed in the path of travel 40 beyond the deck's downstream and 52, and separating and feeding such sheets 10 from the stack 38 into the transverse path of travel 62, and thus away from the supporting structure 30 for further processing, preferably as by means of conventional sheet singulating structure 110. For driving the belt system 100, the apparatus 30 includes a conventional motor 112, a suitable gear system 114 which is conventionally connected in driving engagement with the roller 102 and in driven engagement with the motor 112, and a conventional control circuit, such as the microprocessor 98, which is conventionally connected to the motor 112 for control thereof as hereinafter discussed in greater detail.

As shown in FIG. 2, for feeding sheets from the stack 38, the apparatus 30 preferably comprises a second belt system 120, including a pair of rollers, 122 and 124, which are spaced from each other and connected to the framework 32 by means of respective roller shafts 126 and 128 so as to axially vertically extend transverse to the path of travel 40, downstream of the deck's downstream end 52 and in overhanging relationship with the belt 106. The second belt system 120 also includes an endless belt 130 which is looped about and disposed in driven engagement with the rollers 122 and 124. The belt 130 includes a belt run 132 which extends perpendicularly-transverse to the path of travel 40 for receiving thereagainst and frictionally engaging the upright surfaces 18 of respective sheets 10 which are fed in the path of travel 40, beyond the deck's downstream end 52, and cooperating with the belt run 108 for feeding such sheets 10 from the stack 38 in the transverse path of travel 62. For driving the second belt system 120, the apparatus 30 includes the motor 112 and the gear system 114, wherein the gear system 114 is connected in driving engagement with the roller shaft 126, as hereinafter discussed in greater detail, and in driven engagement with the motor 112.

As shown in FIG. 2, the apparatus 30 additionally comprises structure 138 for resiliently urging the second belt system 120 toward the stack 38, whereby the belt 120 is urged into frictional engagement with the upright surfaces 18 of successive sheets 10 of the stack 38. And, more particularly, the structure 138 is constructed and arranged for exerting a substantially constant, resultant, force in a direction extending opposite to the path of travel 40, against the downstream upright surface 18 of each of the sheets 10 as they are fed from the stack 38. To that end, the apparatus 30 preferably includes an elongate, step-shaped, roller spacing member 140, having upper and lower end 142 and 144, to which the upper end of the roller shaft 126 and lower end of the roller shaft 128 are rotatably connected for rigidly spacing the second belt system's rollers 122 and 124 from each other. Preferably, the lower end of the roller shaft 126 is additionally supported by an arm 140A extending from the spacing member 140. In addition, the apparatus 30 includes an elongate, generally rectangularly-shaped, member 146 for pivotally supporting the second belt system 120. To that end, one end, 148, of the member 146 is conventionally axially pivotably attached to the framework 32, as by means of a pivot shaft 149, and the roller shaft 126 is conventionally vertically mounted for rotation on the other end 150 of the member 146. In addition, the apparatus 30 includes a pair of elongate resilient structures, 152 and 154, which are connected to the framework 32 and to the second belt system 120, such that the spacing member's opposite ends 142 and 144, and thus the rollers 122 and 124, are independently movable toward and away from successive sheets 10 fed from the stack 38, to permit the rollers 122 and 124, and thus the belt run 132, to track the surfaces 18 (FIG. 1*e*), and thus the surface ridges 20 which may be present in respective upright surfaces 18 of successive sheets 10, as they are fed from the stack 38.

The resilient structure 152 (FIG. 2) includes an elongate rod 156 having one end, 156A, conventionally pivotably attached to the upper end of the roller shaft 126. The rod 156 extends downstream, relative to the path of travel 40, from the roller shaft 126 and into an upright framework post 158 having a swivel bearing 160 mounted therein for lengthwise receiving therethrough the rod 156. In addition, the resilient structure 152 includes a compression spring 162 connected between the framework post 158 and a stop 164. Preferably, the stop 164 is adjustably connected to the rod 156, to permit adjusting the initial compression of the spring 162 against the swivel bearing 160, whereby the force exerted by the downstream end of the belt run 132 against the stack's downstream end 44 may be adjusted to a predetermined minimum, or threshold, level for reliably feeding sheets from the stack 38. And, the resilient structure 152 includes another stop 165 which is conventionally adjustably connected to the rod 156 between the framework post 158 and the free end 166 of the rod 156, to permit adjusting the initial location of the roller shaft 126, and thus the roller 122, relative to the path of travel 40, whereby the downstream end of the belt run 132 may be adjustably located in the path of travel 40 to accommodate feeding sheets 10 of different thicknesses.

The resilient structure 154 (FIG. 2) includes an elongate rod 168 having one end, 170, conventionally pivotably attached to the end 144 of the spacing member 140. The rod 168 extends downstream, relative to the path of travel 40, from the roller spacing member's end 144 and into an upright framework post 172 having a swivel bearing 174 mounted therein for lengthwise receiving therethrough the rod 168. In addition, the resilient structure 154 includes a compression spring 176 connected between the swivel bearing 174 and a stop 178. The stop 176 is preferably adjustably connected to the rod 168, to permit adjusting initial compression of the spring 176 against the swivel bearing 174, whereby the force exerted by the upstream end of the belt run 132 against the stack's downstream end 44 may be adjusted to the predetermined minimum, or threshold, level for reliably feeding sheets 10 from the stack 38. And, the resilient structure 154 includes another stop 180 which is conventionally adjustably connected to the rod 168 between the framework post 172 and the free end 182 of the rod 168, to permit adjusting the initial location of the roller spacing member's end 144, and thus the roller 124, relative to the path of travel 40, whereby the upstream end of the belt run 132 may be adjustably located in the path of travel 40 to accommodate feeding sheets of different thicknesses.

Due to the second belt systems' supporting structure, 146 (FIG. 2) permitting movement of the belt system's rollers 122 and 124, the gear system 114 is preferably connected for driving the second belt system's roller shaft 126, and thus the belt 130, via a third belt system 190. The belt system 190 preferably includes a first pulley gear 192. The first pulley gear 192 is fixedly connected to a drive shaft 194, which is conventionally rotatably connected to the framework 32. In addition, the belt system 192 includes second and third pulley gears, 196 and 198, which are conventionally fixed to each other and rotatably connected to the pivot shaft 149, and a fourth pulley gear 200 which is conventionally fixedly attached to the roller shaft 126 for rotation thereof. Moreover, the belt system 190 includes a first timing belt 202, which is looped about and disposed in meshing engagement with the first and second pulley gears 192 and 196, and a second timing belt 204, which is looped about and disposed in meshing engagement with the third and fourth pulley gears 198 and 200. And the gear system 114 is conventionally connected to the first pulley gear's drive shaft 194 for rotation by the motor 112 under the control of the microprocessor 98. As thus constructed and arranged, motor drive may be transmitted to the roller 122, and thus to the belt 130, as the roller 122 pivots about the shaft 149, due to the pulley gear 200 and belt 204 pivoting about the pivot shaft 149 via the pulley gear 198.

In operation, the stack 38 (FIG. 2) is fed downstream in the path of travel 40 against the force exerted by the belt 130 on the upright surfaces 18 of respective sheets 10 fed from the stack 38. For controlling downstream movement of the stack 38 and thus the sheets 10, in the path of travel 40, and controlling the maximum force exerted by the belt 130 against the respective sheets 10 fed from the stack 38, the apparatus 30 includes a depending finger member 210 which is connected to the rod 156 for movement therewith into and out of actuating engagement with the leaf spring-type switching poles, 212 and 214, of two microswitches 216, and 218, which are conventionally electrically connected to the microprocessor 98. Preferably, the finger member 210 is conventionally adjustably connected to the rod 156 to permit changing the location of the finger member 210 relative to the switching pole 212, whereby the finger member 210 may be located at a predetermined position along the rod 156 for actuating the switch 216 when the force exerted by the upstream end of the belt run 132 against the stack's downstream end 44 increases to a predetermined maximum permissible level for reliably feeding sheets 10 from the stack 38. Further, the switch 216 is preferably a normally closed switch, and the switch 218 is preferably a normally open switch. Further, the switches 216 and 218 are respectively conventionally connected to the framework 32 for disposing their respective leaf spring-type switching poles, 212 and 214, in slidable engagement with each other, whereby movement of either of the switching poles, 212 or 214, causes movement of the other switching pole, 214 or 212. Moreover, the switching poles 212 and 214 are located relative to each other such that the pole 214 normally resiliently retains the pole 212 in a position wherein the switch 216 is closed.

In addition, for controlling movement of the stack 38 (FIG. 2) and the force exerted by the belt 130 against successive sheets 10, the microprocessor 98 is conventionally programmed for energizing both of the motors 94 and 112, in the presence of signals from the switches 216 and 218 which indicate that the normally closed switch 216 is closed and the normally open switch 218 is open, to cause the movable wall 70, and thus stack 38, to move downstream in the path of travel 40, and to cause the belts 106 and 130 to successively separate sheets 10 from the stack 38 and feed the separated sheets 10 into the transverse path of travel 62. Moreover, the microprocessor 98 is conventionally programmed to deenergize the motor 94, in the presence of signals from the switches 216 and 218 which indicate that the normally closed switch 216 is open and the normally open switch 216 is open, i.e., when the finger member 210 actuates the switch 216 but does not actuate the switch 218, to deenergize the motor 94 to stop downstream movement of the stack 38, and to continue energization of the motor 112 to permit continued movement of the belts 106 and 130, for continuing to successively separate and feed sheets from the stack 38.

For stopping sheet feeding from the stack 38 in the event of a jam condition, for example when sheets 10 fed from the stack 10 accumulate between the downstream end of the stack 38 and the belt 130 and singulating structure 110, the microprocessor 98 is conventionally programmed to deenergize both of the motors, 94 and 112, in the presence of signals from the switches 216 and 218 which indicate that the normally closed switch 216 is open and the normally open switch 218 is closed, i.e., when force exerted by the belt 130 against the stack 38 exceeds the maximum predetermined permissible level and the finger member 210 actuates both switches 216 and 218, to maintain deenergization of the motor 94, to continue to stop downstream movement of the stack 38, and to deenergize the motor 112 to stop feeding sheets 10 from the stack 38.

Accordingly, the apparatus 30 is constructed and arranged such that the belt system 84, under the control of the microprocessor 98, is normally intermittently operated for feeding sheets 10 in the path of travel 40 in timed relationship with the belt systems 100 and 120 reliably feeding sheets 10 from the stack 38. And, the apparatus 30 is constructed and arranged such that the belt system 120 ceases feeding sheets 10 from the stack 10 when the belt system 120 is no longer operable for reliably feeding sheets 10 from the stack 38.

Further, the apparatus 30 includes a conventional power supply which is suitably connected to the respective motors 94 and 112, and to the microprocessor 98, to provide power thereto. And, the apparatus 30 may include appropriate an operator interface, such as a keyboard 222 which is conventionally connected to the microprocessor 98 for initiating and discontinuing operation of the apparatus 30 in accordance with operator input from the keyboard 222.

In accordance with the objects of the invention there has been disclosed improved means for feeding sheets of different thicknesses from a stack, including improved structure for controlling the force exerted by the feeding means against the stack, and, in particular for exerting a substantially constant force against respective sheets fed by the feeding means.

What is claimed is:

1. Apparatus for feeding sheets respectively having an upright surface and a lower edge, the apparatus comprising:

a. means for supporting a stack of said sheets on said lower edges thereof;

b. first means for feeding said sheets of said stack in a downstream path of travel;

c. second means for feeding successive sheets on said lower edges thereof from said stack in a direction extending transverse to said path of travel, said second sheet feeding means including a pair of vertically axially oriented rollers, said second sheet feeding means including an endless belt looped about said rollers and having a belt run extending therebetween for frictionally engaging the upright surface of each successive sheet;

d. means for resiliently urging said belt run into engagement with said upright surface of each successive sheet, and said means for resiliently urging including first and second springs respectively resiliently urging a different one of said rollers and thus said belt toward said stack, whereby said belt run is resiliently urged into frictional engagement with said upright surface of each successive sheet.

2. The apparatus according to claim 1, wherein said stack has an upstream end, and said first sheet feeding means includes a movable wall disposed in engagement with the upstream and of said stack, and said first sheet feeding means including a timing belt for moving said wall.

3. The apparatus according to claim 1, wherein said stack has an upstream end, and said first sheet feeding means including a wall disposed in engagement with the upstream end of said stack.

4. The apparatus according to claim 1, wherein said first sheet feeding means includes means for incrementally moving said stack in said downstream path of travel.

5. The apparatus according to claim 1, wherein said stack has an upstream end, said stack supporting means including an elongate feed deck, said stack supporting means including an elongate side wall extending parallel to said downstream path of travel, said stack supporting means including an end wall slidably connected to said side wall and disposed in engagement with the upstream end of the stack, and said first sheet feeding means including means for moving said end wall and thus said stack in said downstream path of travel, whereby the sheets of said stack are fed in said downstream path of travel.

6. The apparatus according to claim 5, wherein said side wall defines said downstream path of travel.

7. The apparatus according to claim 5, wherein said means for moving said end wall includes a first belt, and the end wall including a portion thereof disposed in engagement with said first belt.

8. The apparatus according to claim 1 including means for operating said first sheet feeding means in timed relationship with said second sheet feeding means.

9. The apparatus according to claim 1, wherein said second means for feeding said sheets from said stack in said direction extending transverse to said path of travel includes means for frictionally engaging the lower edge of each successive sheet.

10. The apparatus according to claim 9, wherein the lower edge is a fold edge.

11. Apparatus for feeding sheets respectively having a surface and elongate edge, the apparatus comprising:

a. means for supporting a stack of said sheets on their respective edges, whereby said sheet surfaces are respectively disposed in an upright orientation thereof, said supporting means having a downstream end;

b. means for feeding the stack in a first path of travel extending beyond the downstream end of the stack supporting means;

c. means for feeding respective sheets from the stack in a direction extending transverse to said path of travel, said sheet feeding means including a pair of rollers spaced apart from each other, said sheet feeding means including an endless belt looped about said rollers and having a belt run disposed therebetween for engagement of the upright surface of each sheet fed beyond said downstream end of said sheet supporting means, said stack feeding means successively moving respective sheets of the stack into engagement with the belt run to permit said belt to successively separate respective sheets from the stack;

d. means for resiliently urging said belt run into frictional engagement with successive upright surfaces;

e. framework, said sheet feeding means including an elongate member having one end pivoted to the framework and the other end connected for supporting said rollers, said resilient urging means including a first spring connected between said framework and one of said rollers and a second spring connected between said framework and the other of said rollers, and said first and second springs independently urging said rollers and thus said belt toward said stack, whereby said belt run is urged into frictional engagement with successive upright surfaces.

12. The apparatus according to claim 11, wherein said stack has an upstream end, said stack feeding means including an upright wall disposed in engagement with said upstream end of said stack, and said stack feeding means including means for incrementally moving said wall and thus said stack toward said downstream end of said sheet supporting means.

13. The apparatus according to claim 11, wherein said stack feeding means includes a stepper motor, said stack feeding means including means for operating said stepper motor and said belt moving means in a timed relationship with each other.

14. The apparatus according to claim 11, wherein said stack supporting means includes a stack supporting wall extending transverse to said path of travel, said stack feeding means including a gear belt disposed in engagement with said stack supporting wall, and said stack feeding means including means for incrementally moving said gear belt and thus said stack supporting wall in timed relationship with feeding respective sheets from the stack.

15. The apparatus according to claim 11, wherein said stack supporting means includes an elongate deck having said downstream end, and said stack supporting wall slidably connected to said deck.

16. The apparatus according to claim 11 wherein said resilient urging means is constructed and arranged to cause said belt run to exert a substantially constant force against said upright surface of each successive sheet.

17. Apparatus for feeding sheets respectively having an elongate fold edge, the apparatus comprising:

a. means for supporting a stack of said sheets on their respective fold edges, whereby each sheet has an upright surface thereof, the supporting means having a downstream end;

b. means for moving the stack and thus the sheets thereof in a downstream path of travel to the downstream end of the stack supporting means;

c. means at the downstream end of the stack supporting means for feeding respective sheets from the stack, said sheet feeding means including a first movable belt for frictionally engaging the fold edge of each successive sheet, said sheet feeding means including a second movable belt for frictionally engaging an upright surface of each successive sheet, said belts movable for feeding successive sheets from said stack in a direction extending transverse to said path of travel; and d. means for resilient urging said second belt toward said stack.

* * * * *